US008791871B2

(12) United States Patent
Platt

(10) Patent No.: US 8,791,871 B2
(45) Date of Patent: Jul. 29, 2014

(54) OPEN SLOT TRAP FOR A DIPOLE ANTENNA

(75) Inventor: John Jeremy Churchill Platt, Grand Haven, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 328 days.

(21) Appl. No.: 13/341,984

(22) Filed: Dec. 31, 2011

(65) Prior Publication Data

US 2012/0268337 A1 Oct. 25, 2012

Related U.S. Application Data

(60) Provisional application No. 61/477,647, filed on Apr. 21, 2011.

(51) Int. Cl.
*H01Q 9/28* (2006.01)

(52) U.S. Cl.
USPC ..... 343/795; 343/790; 343/792

(58) Field of Classification Search
CPC ..... H01Q 1/38; H01Q 9/16
USPC ..... 343/790, 791, 792, 793, 795
See application file for complete search history.

(56) References Cited

U.S. PATENT DOCUMENTS

| | | | | |
|---|---|---|---|---|
| 6,057,804 | A * | 5/2000 | Kaegebein | 343/792 |
| 6,337,667 | B1 * | 1/2002 | Ayala et al. | 343/795 |
| 7,589,694 | B2 * | 9/2009 | Martek et al. | 343/895 |
| 7,724,201 | B2 * | 5/2010 | Nysen et al. | 343/821 |
| 2004/0145522 | A1 | 7/2004 | Wang et al. | |
| 2008/0030408 | A1 | 2/2008 | Coates et al. | |
| 2012/0169560 | A1 * | 7/2012 | Lee et al. | 343/770 |

FOREIGN PATENT DOCUMENTS

| | | | |
|---|---|---|---|
| JP | 2004 254002 | A | 9/2004 |
| WO | 99/21245 | A1 | 4/1999 |

OTHER PUBLICATIONS

Yanfei Li et al, Design of high performance sleeve dipole array antenna; Antenna Technology (IWAT), 2011 International Workshop on, IEEE, Mar. 7, 2011, pp. 168-171, XP031942661, DOI: 10.1109/IWAT.2011.5752275, ISBN: 978-1-4244-9133-9.

* cited by examiner

*Primary Examiner* — Tho G Phan
(74) *Attorney, Agent, or Firm* — McGarry Bair PC

(57) ABSTRACT

A dipole antenna includes a circuit board with a first side and a second side, at least one dipole disposed on the circuit board comprising an upper half and a lower half, a microstrip transmission line disposed on the circuit board coupled to at least one of the upper half and lower half of the at least one dipole, and a choke element disposed on the circuit board. The choke element and the lower half of the at least one dipole form an open slot trap with a high impedance point.

14 Claims, 5 Drawing Sheets

OPEN SLOT TRAP FOR A DIPOLE ANTENNA

CROSS-REFERENCE TO RELATED APPLICATION

This application claims the benefit of U.S. provisional application Ser. No. 61/477,647, filed Apr. 21, 2011, which is incorporated herein in its entirety.

Antennas implemented on circuit boards can have various advantages such as a small form factor, low cost of manufacture, and a compact and robust housing. A dipole antenna in particular can be implemented on a circuit board using standard methods of manufacturing circuit boards. Therefore circuit board manufacturing methodologies provide design flexibility in terms of designs that can be implemented on both sides of the printed circuit board. Furthermore, the mass manufacturing techniques employed in circuit board manufacturing can lead to low cost and highly reliable antennas on a rigid substrate. In such antenna designs, many of the elements of the antenna can be implemented on the printed circuit board or as discrete parts, including the dipole of the antenna, as well as, feed points, transmission lines, and external connections.

A choke provides electrical isolation between electrical elements by way of a high impedance path and is known to be used in whip antennas and dipole antennas.

BACKGROUND OF THE INVENTION

Brief Description of the Invention

A dipole antenna includes a circuit board with a first side and a second side, at least one dipole disposed on the circuit board comprising an upper half and a lower half, a microstrip transmission line disposed on the circuit board coupled to at least one of the upper half and lower half of the at least one dipole, and a choke element disposed on the circuit board. The choke element and the lower half of the at least one dipole form an open slot trap with a high impedance point.

DETAILED DESCRIPTION OF THE DRAWINGS

The present invention relates generally to antennas, and more specifically to an open slot trap for an end fed dipole on a circuit board. The open slot trap incorporates a choke that is fabricated on the circuit board rather than a discrete part attached to the circuit board to provide a reliable and low cost dipole antenna implementation.

Figure 1:
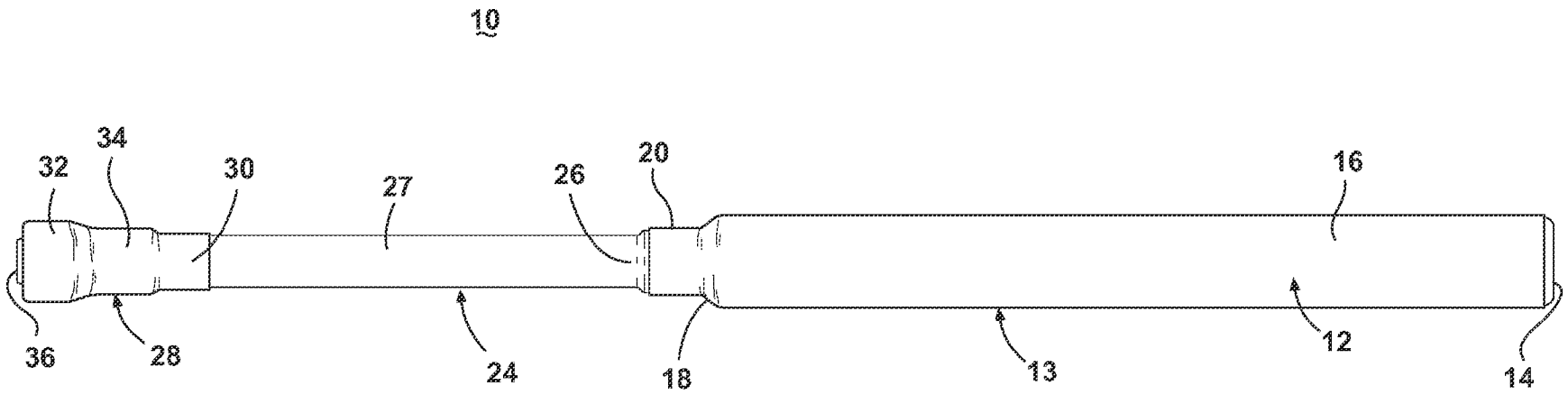
FIG. 1 is a schematic diagram of an end fed dipole antenna according to one embodiment of the current invention with a gooseneck cable attached thereto.

Referring now to FIG. 1, the external features of the end fed dipole antenna with a gooseneck cable 10 are discussed. The end fed dipole antenna 12 comprises a radome 13 with an end wall 14, sidewall 16, a tapered portion 18, and an end connector 20. The radome 13 is generally a length, girth, and volume sufficient to house a dipole antenna board within. The radome 13 may be cylindrical in shape with cylindrical sidewalls 16 and a circular end wall 14. Alternatively, the radome 13 can be any other suitable shape including a rectangular box with a rectangular end wall 14. The tapered portion 18 is provided as a transition of the sidewall 16 the end connector 20. The radome 13 may be formed by any known method including, but not limited to injection molding and extruding. The materials for forming the radome 13 may be any suitable material that will not act as a Faraday cage for the antenna board and components contained therein, including, but not limited to thermoplastic materials. The exact shape and material of construct of the radome 13 does not detract from the embodiments of the inventions described herein.

The end connector 20 can have a mechanical connector mechanism (not shown) to connect the end fed dipole antenna 12 to a cable 24. The cable 24 comprises a cable to antenna connector 26, a conductive cord portion 27 and a cable end connector 28. The cable 24 can be a gooseneck cable where the conductive cord portion 27 can be mechanically bent in various directions. The cable end connector 28 further comprises a cable end connector mechanical interface 30, a cable end connector mechanical connection 32, a cable end connector tapered portion 34, and a cable end connector electrical interface 36. The cable to antenna connector 26 and the cable end connector 28 can be of any known type of radio frequency (RF) coaxial connector including, but not limited to, SubMiniature version A (SMA) and Bayonet Neill-Concelman connector (BNC).

The embodiments shown and the dimensions, parameters, and values of components, traces, and circuit boards are directed to a dipole antenna with a frequency band between 1200 MHz and 1400 MHz. The invention disclosed herein is not limited to this frequency band and can be directed to any frequency band or to multiple frequency bands and implemented on a multiband antenna. As such the dimensions, parameters, and values of any elements discussed herein are not limitations to the invention, but merely examples of one known implementation of the invention in a particular target frequency band.

Figure 2:
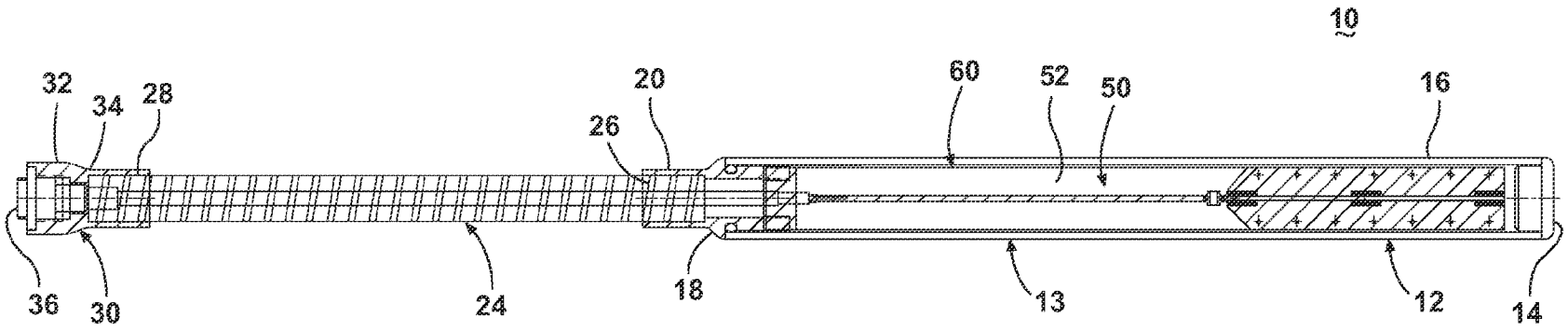
FIG. 2 is a cross sectional view from one side of the end fed dipole antenna of FIG. 1 with the gooseneck cable attached thereto.
Figure 3:
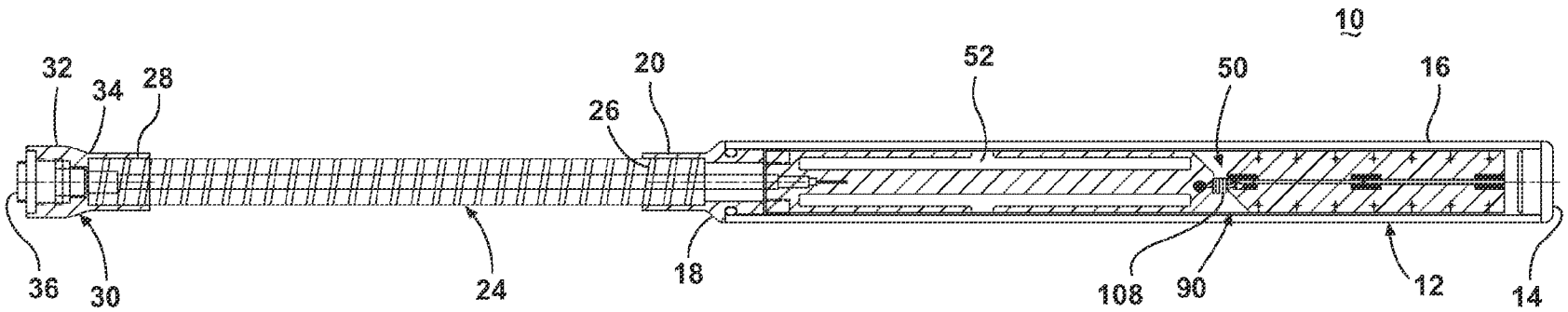
FIG. 3 is a cross sectional view from another side of the end fed dipole antenna of FIG. 1 with the gooseneck cable attached thereto.

Referring now to FIGS. 2 and 3, dipole antenna board 50 contained within the radome 13 is discussed. The dipole antenna board 50 comprises a first side 60 and a second side 90 of a circuit board 52. The dipole antenna board 50 therefore is the circuit board 52 with various components and electrical traces disposed thereon on both the first side 60 and the second side 90 and housed within the radome 13 to form the end fed dipole antenna 12. The circuit board 52 can be any known insulative material used for such applications, including but not limited to FR-4.

The circuit board 52, although not dimensionally limited, can be approximately 0.5 inches (1.77 cm) in width and 6 inches (15.2 cm) in length for the frequency band discussed in this application.

Figure 4:
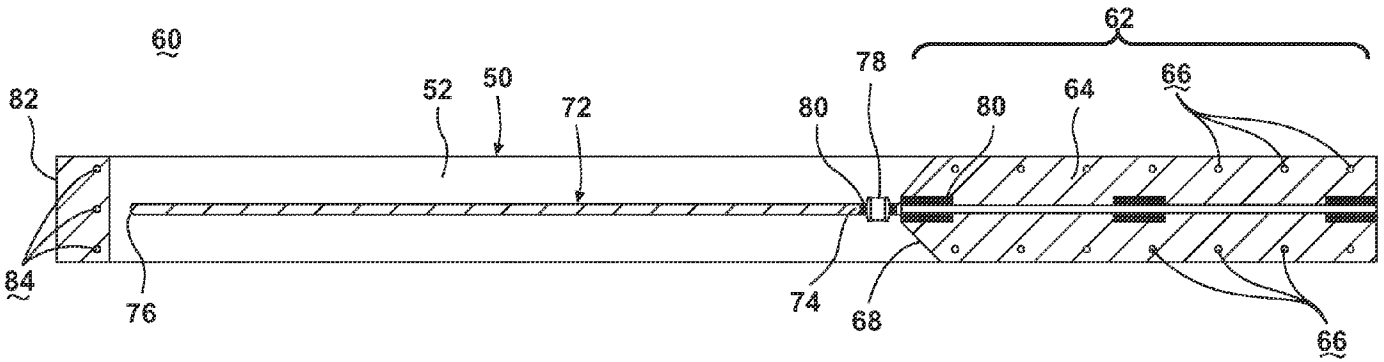
FIG. 4 is a front side view of a printed circuit board of the end fed dipole antenna of FIG. 1 with an open slot trap thereon.
Figure 5:
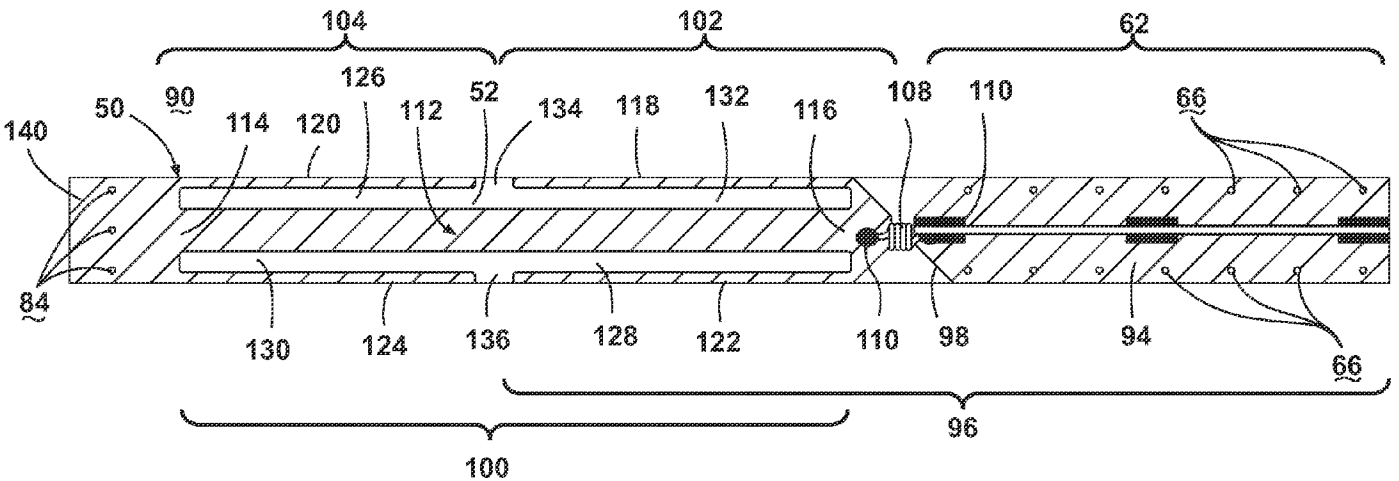
FIG. 5 is a back side view of a printed circuit board of the end fed dipole antenna of FIG. 1 with an open slot trap thereon.

Referring now to FIGS. 4 and 5, further details of the dipole antenna board 50 and structures on both the first side 60 and second side 90 are discussed. The dipole antenna board 50 comprises a dipole 96 with an upper half 62 and a lower half 102 of the dipole 96. On the first side 60, the upper half 62 comprises a first side conductive element 64 disposed on the circuit board 52, through-holes 66 that extend from the first side 60 to the second side 90 of the circuit board, and a tapered portion of the conductive element 68. The upper half 62 of the dipole 96 on the second side 90 comprises a second side conductive element 94, tapered portion 98 of the conductive element 94, and the through-holes 66 through the second side conductive element 94.

The first side conductive element 64 and the second side conductive element 94 are connected by the through-holes 66. In this case the through-holes 66 are electrically conductive. The through-holes 66, as well as, the first side conductive element 64 and the second side conductive element 94 may be formed concurrently by methods known in the field of circuit board manufacturing, such as by electroless plating or electroplating. The through-holes 66 may have a sufficient diameter, such that the aspect ratio of the through-holes 66 is low enough to allow for reliable deposition of metal within the through-holes 66. For example, if the circuit board 52 has a thickness of 0.035 inches (0.089 cm), and the circuit board manufacturing methods allow through-holes of aspect ratio of 1:1, then the diameter of the through-holes 66 must also be 0.035 inches (0.089 cm).

On the first side 60, the upper half 62 of the dipole 96 is connected to a microstrip transmission line 72 disposed on the circuit board 52 and connected via a capacitor 78 in series. The microstrip transmission line 72 comprises a feed point 74 for the dipole 96 on one end and an end connector attachment point 76 on the other end. The microstrip transmission line can be approximately 0.025 inches (0.64 cm) in width and 3.238 inches (8.2 cm) in length.

The feed point 74 is connected to the conductive element 64 of the upper half 62 of the dipole 96 via capacitor 78. The capacitor 78 is attached to both the feed point 74 and the tapered end 68 by solder or any other known method of attaching discrete components to circuit boards. The solder 80 can be of any known type including, but not limited to, standard lead-tin (Pb—Sn) alloy or tin-silver-copper (SAC) alloy to meet stringent environmental regulations of Europe and Japan. The solder 80 may be applied to the circuit board 52 by any known method including, but not limited to, screen printing solder paste or high volume wave soldering techniques. The capacitor 78 is one possible element for electrically coupling the feed point 74 to the upper half 62 of the dipole 96. Alternatively, the electrical coupling between the feed point 74 and the upper half 62 of the dipole can be a resistor, a shorted connection (low resistance resistor), or an inductor. Furthermore, the connection element and its resulting impedance can be chosen to tune the dipole antenna 12 or to provide a filtering mechanism for the signals provided to or coming from the dipole antenna 12. The cable attachment point 76 is mechanically and electrically connected to the cable 24 by way of antenna connector 26. There is also a ground connector element 82 on the first side 60 that provides a ground connection to the cable to antenna connector 26 of the cable 24.

On the second side 90 of the dipole antenna board 50, the upper half 62 of the dipole 96 is connected to the lower half 102 of the dipole 96 via an inductor 108. As in the case of the capacitor 78, the inductor 108 is attached to the upper half 62 and the lower half 102 via solder joints 110. The inductor 108 is one possible element for electrically coupling the upper half 62 of the dipole 96 to the lower half 102 of the dipole 96. Alternatively, the electrical coupling between the upper half 62 and the lower half 102 can be a resistor, a shorted connection (low resistance resistor), or a capacitor. Furthermore, the connection element and its resulting impedance can be chosen to tune the dipole antenna 12 or to provide a filtering mechanism for the signals provided to or coming from the dipole antenna 12.

The lower half 102 of the dipole 96 comprises a first sleeve trace 118 and a second sleeve trace 122 that each run along the edges on the second side 90 of the circuit board 52 and a center trace element 112 that runs along the length near the middle of the circuit board 52 on the lower half 102 of the dipole 96 and extends beyond the lower half 102. The traces 118, 122, and 112 are separated from each other by non-conductive gaps 128 and 132 therebetween. All of the traces 118, 122, and 112 extend from a tapered element 116 of the lower half 102 of the dipole 96 to which one end of the inductor 108 is attached. The traces 118, 122, and 112 disposed on the second side 90 are physically isolated from the microstrip transmission line 72 disposed on the first side 60.

The center trace element 112 extends through an open slot trap 100. The open slot trap 100 comprises the lower half 102 of the dipole 96, as well as, a quarter wave choke 104. The quarter wave choke 104 comprises edge sleeve traces 120 and 124 that are disposed along the edges of the second side 90 of the circuit board 52. The center trace element 112 extends through the middle of the circuit board 52 between the edge sleeve traces 120 and 124 and is separated from the edge sleeve traces 120 and 124 by non-conductive gaps 126 and 130. The open slot trap 100 edge sleeve traces 120 and 124 are separated from the edge sleeve traces 118 and 122 of the lower half 102 of the dipole 96 by open slots 134 and 136. The end of the open slot trap 100 is in contact with a ground connector element 140 on the second side 90 at a connection point 114 that in turn is connected to the ground connector element 82 on the first side 60 of the circuit board 52 via plated through-holes 84 and to the ground connection of the cable to antenna connector 26.

The center trace element 112 can have a width of 0.2 inches (0.51 cm) and a length of 3.18 inches (8.08 cm). Sleeves 118, 120, 122, and 124 can have a width of 0.05 inches (0.13 cm) and a length of 1.4 inches (3.56 cm). The open slots 134 and 136 can have a width of 0.18 inches (0.46 cm).

In operation, the open slots 134 and 136 are high voltage and high impedance regions. Therefore the open slot trap 100 is enabled by the choke 104 at the resonant frequency band of the dipole 96. The open slot trap 100 is implemented on the circuit board 52 using common batch techniques for fabricating the dipole antenna board 50, leading to low cost, manufacturing repeatability, and high reliability in a compact form factor.

Figure 6:
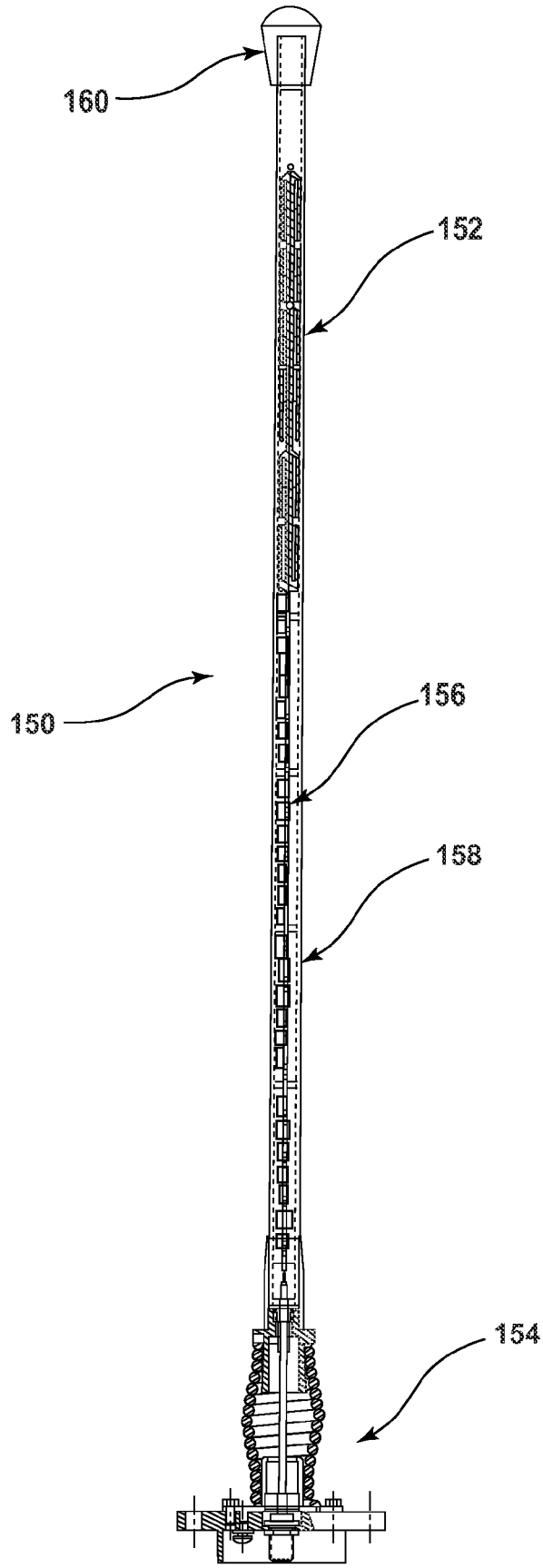
FIG. 6 is a transparent view of an end fed dipole antenna according to a second embodiment of the current invention.
Figure 7:
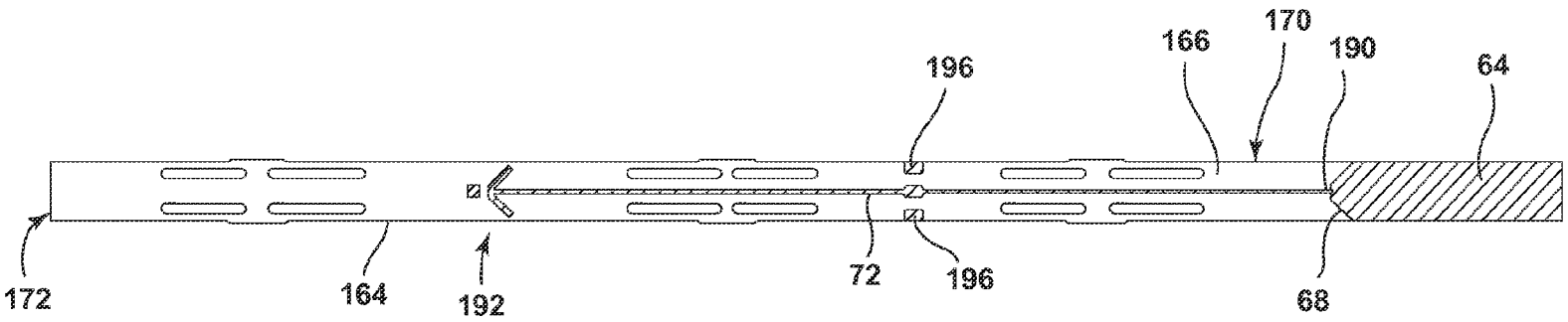
FIG. 7 is a front side view of a printed circuit board of the end fed dipole antenna of FIG. 5 with several open slot traps thereon.
Figure 8:
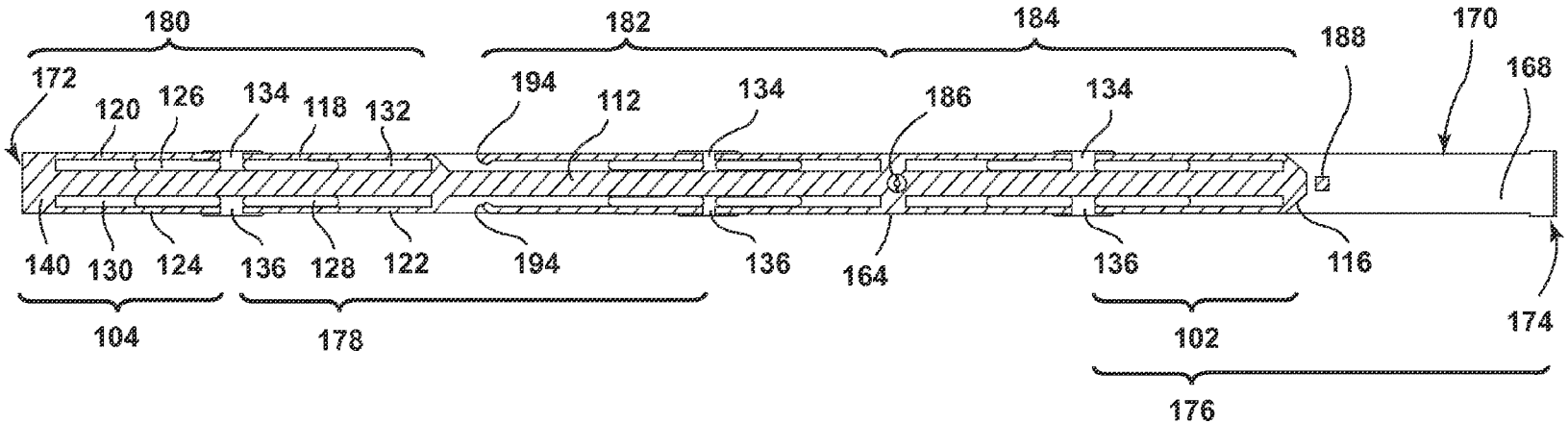
FIG. 8 is a back side view of a printed circuit board of the end fed dipole antenna of FIG. 5 with several open slot traps thereon.

Referring now to FIG. 6, a second embodiment end fed dipole antenna including an antenna base 150 is illustrated comprising a second embodiment end fed dipole antenna 152 electrically coupled with a transmission line 156, both enclosed within a radome 158 closed off with an end cap 160. The second embodiment end fed dipole antenna 150 shares several features of the first embodiment end fed dipole antenna 12. Thus, like reference characters will be utilized to identify like elements. Like elements described with respect to the first embodiment sharing structure and functionality with the second embodiment will not FIGS. 7 and 8 illustrate a dipole antenna board 170 having, respectively, a first side 166 and a second side 168. The dipole antenna board 170 comprises a circuit board 164 having a proximal end 172 and a distal end 174, with an upper, or first, dipole 176 and a lower, or second, dipole 178, illustrated in FIG. 8. The circuit board 164 comprises a first open slot trap 180, a second open slot trap 182, and a third open slot trap 184, sequentially arrayed along the second side 168 from the proximal end 172 to the distal end 174. The open slot traps 180, 182, 184, are identical in several respects to the open slot trap 100 of the first embodiment dipole antenna board 50.

The second embodiment dipole antenna board 170 comprises a first side conductive element 64 disposed on the first side 166 of the circuit board 164, having a tapered portion 68 electrically coupled with the second side 168 via a through-hole 188. The through-hole 188 is made electrically conductive by methods known in the field of circuit board manufacturing, such as by an etching process, silk screening, sputtering, electroless plating, electroplating, and the like. As with the through-holes 66, the through-hole 188 can have a sufficient diameter, such that the aspect ratio of the through-hole 188 is low enough to allow for reliable deposition of metal within the through-hole 188.

On the first side 166, the first side conductive element 64 is electrically coupled with a microstrip transmission line 72 disposed on the circuit board 164. The microstrip transmission line 72 is coupled with the first side conductive element 64 at a feed point 190 on one end and a second open slot trap connector 192 on the other end. The feed point 190 is attached to the tapered end 68 of the conductive element 64 by solder or any other known method of attaching discrete components on circuit boards. The solder can be of any known type including, but not limited to, standard lead-tin (Pb—Sn) alloy or tin-silver-copper (SAC) alloy. The solder may be applied to the circuit board 164 by any known method including, but not limited to, screen printing solder paste or high volume wave soldering techniques.

The feed point 190 is shown connected to the conductive element 64 without a capacitor, as in the first embodiment, although a capacitor can be used to facilitate balancing of the dipoles. Alternatively, the electrical coupling between the feed point 190 and the first side conductive element 64 can be a resistor, a shorted connection (low resistance resistor), or an inductor. The connection element and its resulting impedance can be chosen to tune the dipole antenna 152 or to provide a filtering mechanism for the signals provided to or coming from the dipole antenna 152. The second open slot trap connector 192 is mechanically and electrically connected to the second open slot trap 182 by way of through-holes 194, which are identical to the through-hole 188. A ground connector element 82 on the second side 168 can provide a ground connection to a cable-to-antenna connector.

The dipoles 176, 178 can comprise a first sleeve trace 118 and a second sleeve trace 122 that each run along the edges on the second side 168 of the circuit board 164, and a center trace element 112 that runs along the length near the middle of the circuit board 164 from the proximal end 172 to the distal end 174. The traces 118, 122, and 112 are separated from each other by non-conductive gaps 128, 132 therebetween. The traces 118, 122, 112 extend from a tapered element 116 of the first dipole 176. The traces 118, 122, 112 disposed on the second side 168 are physically isolated from the microstrip transmission line 72 disposed on the first side 166.

A region encompassing a mid-portion of the first dipole 176 and a portion of the first and second open slot traps 180, 182 can be overlain with an open sleeve (not shown). The open sleeve can "float" above the dipole antenna board 178 distance approximately equal to one half the board width.

The center trace element 112 extends through the open slot traps 180, 182, 184. The open slot traps 180, 182, 184 comprise half sections of the first dipole 176 and the second dipole 178. The lower half 102 of the first dipole 176 corresponds with the upper half of the third open slot trap 184. The lower half of the first open slot trap 180 corresponds with the quarter wave choke 104. The quarter wave choke 104 comprises edge sleeve traces 120 and 124 that are disposed along the edges of the second side 168 of the circuit board 164. The center trace element 112 extends through the middle of the circuit board 164 between the edge sleeve traces 120, 124, and is separated from the edge sleeve traces 120, 124 by non-conductive gaps 126, 130. The first open slot trap 180 edge sleeve traces 120, 124 are separated from the edge sleeve traces 118, 122 of the lower half 102 of the first dipole 176 by open slots 134, 136. The end of the first open slot trap 180 transitions to a ground connector element 140 on the second side 168.

The center trace element 112 is mechanically and electrically coupled with the microstrip transmission line 72 via a plated through-hole comprising a feed point 186 between the second open slot trap 182 and the third open slot trap 184. An antenna cable (not shown) can extend along and electrically isolated from the center trace element 112 from the proximal end 172 to electrically couple with the feed point 186. Thus, the dipoles 176, 178 can be energized through the feed point 186.

Laterally of the feed point 186, two plated through-holes 196 extend from the first side 166 to the second side 168 of the circuit board 164 to electrically couple with the upper half of the second open slot trap 182 and the lower half of the third open slot trap 184. Thus, the feed point 186 is electrically coupled with the first side conductive element 64, and the second open slot trap connector 192 via the microstrip transmission line 72. The second open slot trap connector 192 is mechanically and electrically coupled with the upper half of the second dipole 178 via the through-holes 194.

The feed point 186 is also mechanically and electrically coupled with the center trace element 112, and is electrically coupled with the lower half of the first dipole 176, the lower half of the third open slot trap 184, the second dipole 178, and the choke 104.

As with the first embodiment, in operation, the open slots 134, 136 are high voltage and high impedance regions. Therefore the open slot traps 180, 182, 184 are enabled by the choke 104 at the resonant frequency band of the dipole 176.

Both embodiments provide a dipole array that is end-fed on a circuit board. The dipoles are separated using open-slot traps, and are connected using microstrip lines. Multiple dipoles can be configured by using multilayer circuit boards. A broadband design is possible by adding open sleeves, such as a second circuit board, foam spacers with foil, elements with the standoffs, and the like. A second circuit board can be longitudinally oriented perpendicular to the dipole antenna board, and supporting a conductor, such as a wire, spaced away from the dipole antenna board and unconnected to the dipoles or open slot traps to serve a parasitic function. The conductor can be oriented so that its midpoint corresponds to the midpoint of a dipole. The second circuit board can also facilitate centering of the dipole antenna board in the radome.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention.

What is claimed is:

1. A dipole antenna comprising:

a circuit board with a first side and a second side;

at least one dipole disposed on the circuit board comprising an upper half and a lower half, the lower half being disposed on the second side;

the upper half including a first side conductive element disposed on the first side electrically connected via at least one through hole to the second side;

a microstrip transmission line disposed on the first side and extending from an end connector attachment point or an open slot trap connector to a feed point;

a choke element disposed on the second side;

a connection element coupling the feed point to the first side conductive element; and an open slot trap formed by the choke element and the lower half of the at least one dipole.

2. A dipole antenna in accordance with claim 1 wherein the microstrip transmission line is coupled with the first side conductive element.

3. A dipole antenna in accordance with claim 1, and further comprising a second dipole disposed on the second side of the circuit board.

4. A dipole antenna in accordance with claim 3, and further comprising two open slot traps wherein the open slot traps comprise half sections of the first dipole and the second dipole.

5. A dipole antenna in accordance with claim 4 wherein the lower half of the first dipole and the choke element form a first open slot trap defining an upper portion and a lower portion, respectively.

6. A dipole antenna in accordance with claim 4 wherein the upper portion of the second open slot trap and the first side conductive element form the second dipole.

7. A dipole antenna in accordance with claim 4, and further comprising a third open slot trap disposed between the first open slot trap and the second open slot trap, defining an upper portion and a lower portion.

8. A dipole antenna in accordance with claim 7 wherein the microstrip transmission line is coupled with at least one of the third open slot trap and the second dipole.

9. A dipole antenna in accordance with claim 7 wherein the open slot trap comprises a center trace element, a first pair of sleeve traces associated with the upper portion and a second pair of sleeve traces associated with the lower portion, the sleeve traces separated from the center trace element by non-conductive gaps, and the first pair of sleeve traces separated from the second pair of sleeve traces by open slots.

10. A dipole antenna in accordance with claim 9 wherein the first open slot trap, the second open slot trap, and the third open slot trap are coupled by the center trace element.

11. A dipole antenna in accordance with claim 1 wherein at least one of the at least one dipole, the choke element, the open slot trap, and the first side conductive element are formed on the circuit board by one of an etching process, silk screening, sputtering, electroless plating, and electroplating.

12. A dipole antenna in accordance with claim 1 wherein the dipole antenna is enclosed in a radome.

13. A dipole antenna in accordance with claim 1 wherein the dipole antenna is enclosed in a radome with a connection to an external cable.

14. A dipole antenna in accordance with claim 1 wherein the dipole antenna is enclosed in a radome with a connection to an external gooseneck cable.

* * * * *